US008225537B2

(12) United States Patent
Scruggs

(10) Patent No.: US 8,225,537 B2
(45) Date of Patent: Jul. 24, 2012

(54) POSITIONING AND ROTATING APPARATUS FOR INTERRING SCREW-IN AND SELF DIGGING BURIAL CONTAINERS

(76) Inventor: Donald E. Scruggs, Chino, CA (US)

( * ) Notice: Subject to any disclaimer, the term of this patent is extended or adjusted under 35 U.S.C. 154(b) by 0 days.

(21) Appl. No.: 13/134,360

(22) Filed: Jun. 6, 2011

(65) Prior Publication Data

US 2011/0225855 A1 Sep. 22, 2011

Related U.S. Application Data

(63) Continuation-in-part of application No. 12/586,991, filed on Sep. 30, 2009, now abandoned.

(51) Int. Cl.
*E02F 5/16* (2006.01)

(52) U.S. Cl. ..... 37/300

(58) Field of Classification Search ..... 405/232, 405/237, 244, 252.1, 253; 37/300; 248/545
See application file for complete search history.

(56) References Cited

U.S. PATENT DOCUMENTS

| | | | | | |
|---|---|---|---|---|---|
| 2,237,383 | A | * | 4/1941 | Agostineto | 175/21 |
| 2,550,045 | A | * | 4/1951 | De Hetre | 81/57.18 |
| 2,705,614 | A | * | 4/1955 | McKibben et al. | 81/57.16 |
| 3,129,013 | A | * | 4/1964 | Thompson et al. | 279/109 |
| 3,148,510 | A | * | 9/1964 | Sullivan | 405/259.1 |
| 3,148,739 | A | * | 9/1964 | Mattingly et al. | 173/46 |
| 3,191,788 | A | | 6/1965 | Hopfeld | 214/701 |
| 3,198,366 | A | | 8/1965 | Figenshau | 214/652 |
| 3,319,724 | A | | 5/1967 | Cunningham | 173/119 |
| 3,380,323 | A | * | 4/1968 | Campbell | 81/54 |
| 3,690,387 | A | | 9/1972 | Dixon | 173/43 |
| 3,734,204 | A | | 5/1973 | Wallace | 173/143 |
| 3,833,562 | A | | 8/1973 | Petres | 61/53.5 |
| 3,763,654 | A | | 10/1973 | Matsushita | 61/53.5 |
| 3,771,610 | A | | 11/1973 | Leyrat | 173/46 |
| 3,830,315 | A | * | 8/1974 | Love | 173/26 |
| 3,833,072 | A | | 9/1974 | Back | 175/85 |
| 3,848,753 | A | | 11/1974 | Borg | 214/1 B |
| 3,869,003 | A | | 3/1975 | Yamada et al. | 175/171 |
| 3,921,730 | A | * | 11/1975 | Farre et al. | 173/46 |
| 4,014,144 | A | | 3/1977 | Gale | 52/157 |
| 4,023,449 | A | * | 5/1977 | Boyadjieff | 81/57.16 |
| 4,040,260 | A | | 8/1977 | Pryke | 51/53.62 |
| 4,133,206 | A | | 1/1979 | Hida et al. | 73/133 |
| 4,199,033 | A | * | 4/1980 | Van Gundy, Jr. | 173/27 |
| 4,334,392 | A | | 6/1982 | Dziedzic | 52/157 |
| 4,417,628 | A | * | 11/1983 | Gessner | 173/29 |
| 4,467,575 | A | | 8/1984 | Dziedzic | 52/157 |
| 4,688,969 | A | * | 8/1987 | Bruser et al. | 405/303 |
| 4,708,530 | A | * | 11/1987 | Faber | 405/252 |
| 4,719,978 | A | | 1/1988 | Klemm | 175/113 |
| 4,785,892 | A | * | 11/1988 | Luen | 173/28 |
| 4,860,837 | A | * | 8/1989 | Robert | 175/113 |

(Continued)

FOREIGN PATENT DOCUMENTS

JP 56012431 A * 2/1981

*Primary Examiner* — Thomas B Will
*Assistant Examiner* — Joan D Misa

(57) ABSTRACT

Apparatus by which screw-in and self digging burial containers may be picked up, maneuvered into a desired position and pressed, rotated and or agitated for the purpose of interring such burial containers at nearly any angle into earth, sand, snow or other receiving material on dry land, wet land or under water.

1 Claim, 3 Drawing Sheets

U.S. PATENT DOCUMENTS 4,961,471 A * 10/1990 Ovens ..... 175/170
5,073,080 A * 12/1991 Blum ..... 414/739
5,170,850 A * 12/1992 Sassak, II ..... 173/18
5,282,701 A 2/1994 An et al. ..... 405/245
5,433,119 A 7/1995 Rogers ..... 73/862.191
5,450,912 A * 9/1995 Cahill et al. ..... 175/57
5,544,979 A * 8/1996 White ..... 405/232
5,626,457 A * 5/1997 Hickman, Jr. ..... 414/739
5,649,377 A * 7/1997 Tanada ..... 37/406
5,733,068 A * 3/1998 Reinert, Sr. ..... 405/232
5,791,820 A * 8/1998 Rempel ..... 405/232
6,216,803 B1 * 4/2001 Deken ..... 175/162
6,234,260 B1 * 5/2001 Coast et al. ..... 175/113
6,305,882 B1 * 10/2001 Coast et al. ..... 405/232
6,641,332 B1 * 11/2003 Alvarado ..... 405/232
6,942,430 B1 * 9/2005 Suver ..... 405/252.1
7,036,606 B2 * 5/2006 Rossi ..... 173/28
7,353,891 B2 * 4/2008 Nolan ..... 175/323
7,591,089 B2 * 9/2009 Keany ..... 37/408
7,631,404 B2 * 12/2009 Scruggs ..... 27/35
7,854,571 B1 * 12/2010 Evarts ..... 405/232
7,950,876 B2 * 5/2011 Suver ..... 405/232
2007/0110521 A1 * 5/2007 Nimens ..... 405/232
2008/0190633 A1 * 8/2008 Johnston et al. ..... 173/184
2010/0031482 A1 * 2/2010 Scruggs ..... 27/2
2010/0031483 A1 * 2/2010 Scruggs ..... 27/21.1
2010/0037490 A1 * 2/2010 Scruggs ..... 37/189
2010/0038613 A1 * 2/2010 Scruggs ..... 256/65.02

* cited by examiner

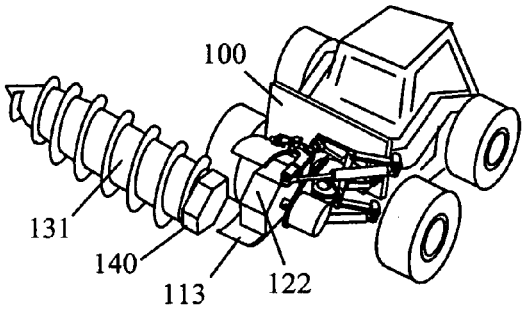
Fig. 8
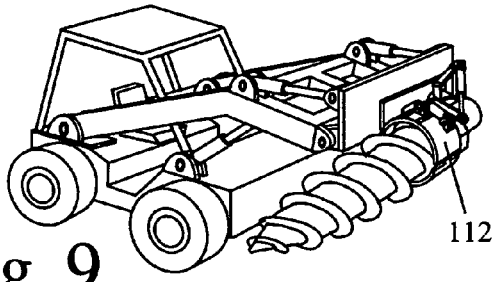
Fig. 9
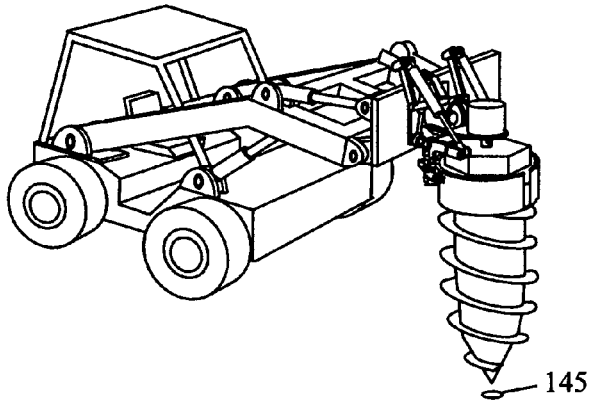
Fig. 10
Fig. 11
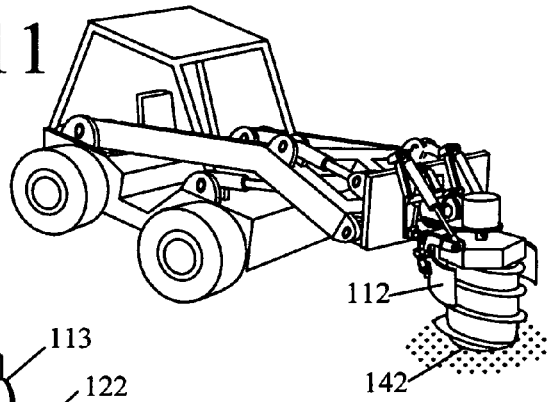
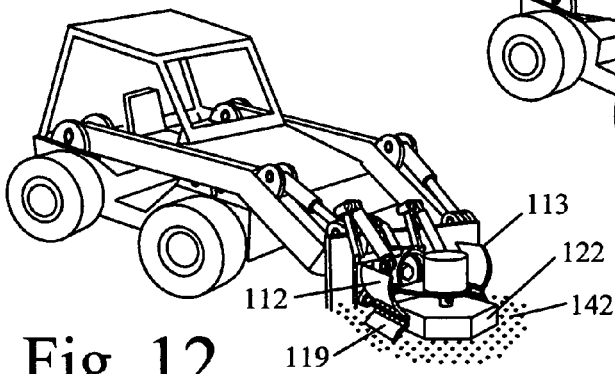
Fig. 12

POSITIONING AND ROTATING APPARATUS FOR INTERRING SCREW-IN AND SELF DIGGING BURIAL CONTAINERS

CROSS-REFERENCE TO RELATED APPLICATIONS

This is a Continuation-In-Part of U.S. patent application Ser. No. 12/586,991, filed 30 Sep. 2009, now abandoned titled Easy Inter Equipment.

FEDERALLY SPONSORED RESEARCH

Not Applicable

NAMES OF PARTIES TO JOINT RESEARCH AGREEMENT

Not Applicable

SEQUENCE LISTING OR PROGRAM

Not Applicable

BACKGROUND OF THE INVENTION

My U.S. Pat. Nos. 7,591,404, titled Easy Inter Burial Container, 8,046,883, titled Edged Non-horizontal Burial Containers and 8,104,153, titled Non-horizontal Burial Methods, disclose several types of threaded screw-in and bladed self digging burial containers which require rotation to be screwed or self dug into the ground and thus illustrate the need for the present invented apparatus. The invented apparatus is specifically designed to provide means of gripping, lifting, transporting, positioning and rotating the screw-in and self-digging burial containers disclosed in these patents.

Current practice for interring horizontally placed burial containers is to dig a hole approximately seven foot deep, by four feet wide by eight feet long and store the removed receiving material for later filling of the hole. A crypt is usually placed at the bottom of the large hole and the coffin is lowered into the crypt. The crypt lid is set in place and a portion of the removed material is placed and tamped around and on the crypt. Grass and other such covering is placed over the top to restore the original appearance of the area and the surplus material is removed from the site. All of which is time consuming and expensive.

A particular problem usually occurs when an installation is in a high water table area. A hole soon fills with water, presenting a near impossible problem for a proper horizontal grave site. Screw-in or self digging burial containers solve the problem by using the apparatus of the present invention for vertical interments. These interments do not require large pre-dug holes as these burial containers can be screwed or self-bored directly into the damp ground by this invention.

FIELD OF THE INVENTION

The present invention relates to apparatus which, when attached to a suitable vehicle, can pick up a threaded screw-in or a bladed self digging burial container, hold the burial container while the vehicle travels to another location and reposition the burial container to the angle in which it is to be interred. The operator of the vehicle and the invented apparatus can move a shaped wrenching section of the apparatus over a matchingly shaped end of said burial container and cause the wrenching section to rotationally screw or dig the burial container into the ground.

RELATED ART

Large cranes, back-hoes, tractors and similar vehicles are often fitted with various types of augers for boring holes in earth into which are inserted piles and building anchors. The same types of equipment are also fitted with rams for forcefully inserting heavy pilings, posts and building anchors where the inserted item is forced into the ground and left. Many of these machines have drives that fit into a receptor in the item to be inserted. None of this type of apparatus can pick up an item, such as a non-horizontal burial container, transport it to the place where it is to be interred ground, maneuver it into position, engage said burial container with a wrenching device, rotate said burial container to cause it to enter the ground and move a section of the apparatus out of the way so that the top of the interred burial container can be set to ground level by the wrenching device. The same types of vehicles used in the boring and ramming of post holes and pilings are often fitted with clamshell buckets or other digging devices and used to dig the large holes required for current horizontal burial containers. These large holes require removal of a large amount of dirt. After a horizontal burial, about half of the dirt is replaced to fill the hole and for ground cover and the rest is transported to another location requiring several vehicle trips.

The present invention is designed to handle non-horizontal threaded screw-in and bladed self digging burial containers, which can replace current horizontal burial containers and the large holes and large land area required for horizontal interments.

OBJECTS OF THE INVENTION

It is a main object of this invention to provide apparatus with which to transport, position and rotate threaded screw-in and bladed self digging burial containers.

It is an object of this invention to reduce the time and cost of a burial by providing means to inter bodies in threaded screw-in or bladed self digging burial containers thus eliminating the digging of a large hole as well as reducing the labor required to handle the left over dirt and clean up and restore the burial site.

It is yet another object of this invention to solve the problem of water filling an initial hole for burial containers in high water table areas, by providing a means to non-horizontally screw, bore or ream burial containers into the ground.

SUMMARY OF THE INVENTION

An apparatus of the present invention is mechanically fitted to a vehicle and the power supply of the vehicle is hooked up to the apparatus. The operator moves the apparatus over a screw-in or self digging burial container lying in a horizontal or other position and sets the shaped wrenching device of the apparatus firmly on the matchingly shaped head of the burial container. The operator closes the gripping arms of the apparatus over the burial container, raises the burial container off of the ground and transports the burial container to the grave site. The operator then turns the burial container to the preferred interment position and maneuvers the burial container over and down onto the interment spot. The operator slightly loosens the gripping arms from around the burial container and begins rotation of the wrenching device, in the correct direction, while pressing the burial container downward.

The preferred embodiment of this invention incorporates the use of hydraulic, electric, air or mechanical powered equipment to inter screw-in and self digging burial containers. Regularly available backhoes, tractors, cranes, loaders, forklifts and the like are fitted with the apparatus of the present invention. This apparatus is made using common metal working practices as it is composed of fabricated metal frames, to which are attached metal fabricated gripping, wrenching and rotating sections, along with commonly available motors and power supplies. Together, these components make up a POSITIONING AND ROTATING APPARATUS FOR INTERRING SCREW-IN AND SELF DIGGING BURIAL CONTAINERS.

The invented apparatus handles and maneuvers said types of burial containers into position and then rotates them into the ground or other receiving material. The invented apparatus is particularly useful to inter said types of burial containers into water covered, swampy, muddy and high water table areas, using the water to assist interment. The invented apparatus is also used to quickly and easily place hollow screw-in or self digging units, in this case called coffers, containing food, water, hardware, information and or other materials safely and securely into dirt, sand, mud, snow or even under water. Other embodiments, ramifications and combinations of the design shown herein are equally preferred.

BRIEF DESCRIPTION OF THE SEVERAL VIEWS OF THE DRAWINGS

FIG. 8 is a perspective view of a vehicle equipped with an apparatus of the present invention which is rotated to a horizontal position and is about to pick up a threaded screw-in burial container. 100 is the front end of the arm of a vehicle; 113 is a front gripping arm; 122 is a wrenching device; 131 is a threaded screw-in burial container; 140 is the head piece of a burial container.

FIG. 9 is a perspective view of a vehicle equipped with an apparatus of the present invention in a horizontal position, moving a threaded screw-in burial container. 112 is a front gripping arm.

FIG. 10 is a perspective view of a vehicle equipped with an apparatus of the present invention positioning a threaded screw-in burial container over the preferred interment point. 145 is the interment point where the burial container is to be interred.

FIG. 11 is a perspective view of a vehicle equipped with an apparatus of the present invention with a partially interred threaded screw-in burial container. 112 is a front gripping arm; 142 is a threaded screw-in burial container being interred.

FIG. 12 is a perspective view of a vehicle equipped with an apparatus of the present invention with its gripping arms pivoted upward to clear the ground for the wrenching device to fully inter a threaded screw-in or bladed self digging burial container. Items 112, 113 and 119 are gripping arms pivoted upward and raised for ground clearance; 122 is a wrenching device; 142 is a fully interred burial container, under the wrenching device.

DETAILED DESCRIPTION OF THE INVENTION

Figure 1:
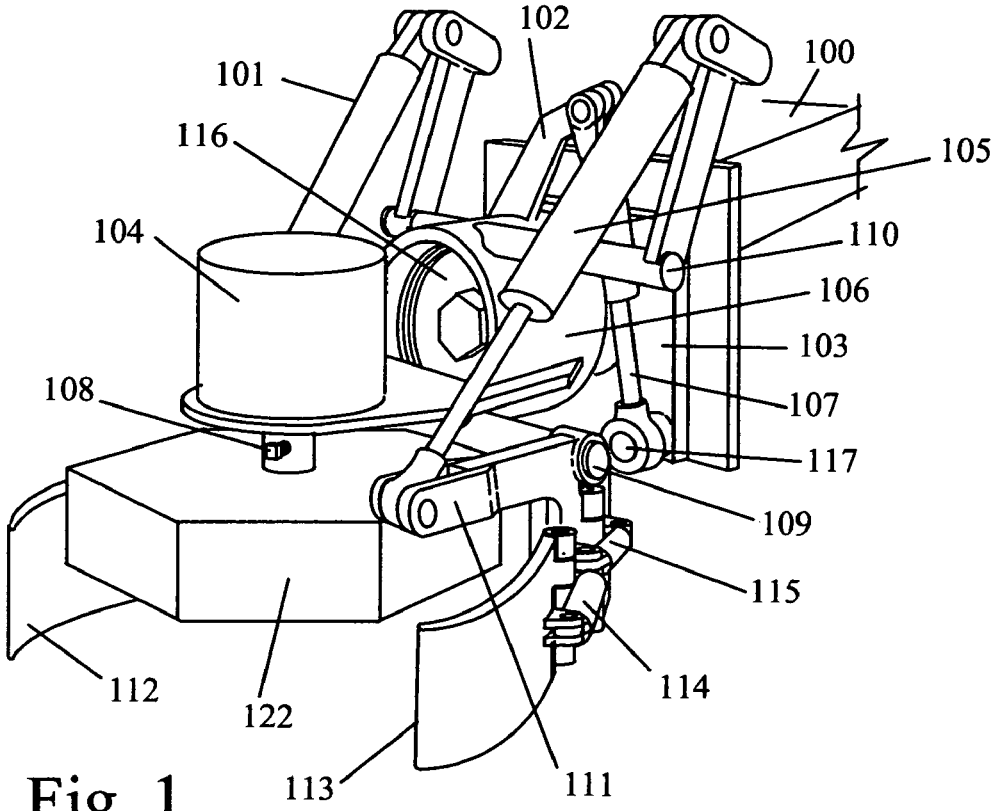
FIG. 1 is a perspective view of the present invention, with its gripping arms, 112 and 113, in a down and opened position and with the apparatus ready to be fitted onto a vehicle, 100, such as a backhoe or tractor; 101 and 105 are extendible and retractable linear actuators; 102 is a support arm; 103 is a first support member which attaches to a vehicle; 104 is a motor; 106 is a second support member which can be made to rotate; 107 is an extendible and retractable linear actuator to control rotation of 106; 108 is the output shaft of motor 104; 109 is a pivot shaft of the gripping arms; 111 is an extending end of the member on which are mounted the gripping arms; 112 and 113 are the front gripping arms; 114 are the extendible and retractable linear actuators moving the front gripping arms; 122 is a wrenching device; 117 is a fixture on which one end of the extendible and retractable linear actuator, 107, is attached.
Figure 4:
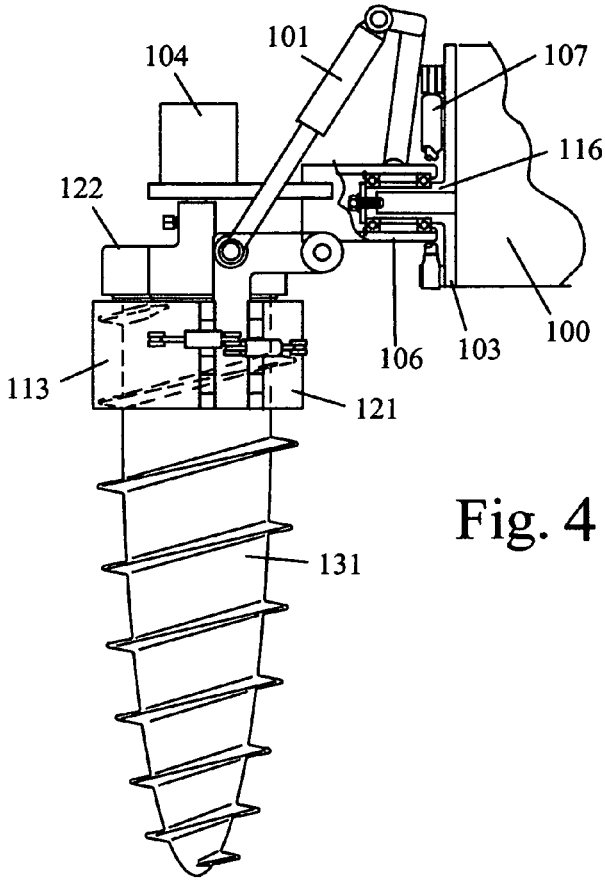
FIG. 4 is a side view of the present invention holding a threaded screw in type burial container in a vertical position. 100 is a vehicle on which is mounted the apparatus; 101 is an extendible and retractable linear actuator controlling the position of the gripping arms; 103 is the mounting frame which mounts on a vehicle; 104 is a motor, 106 is the second support frame; 107 is an extendible and retractable linear actuator controlling the rotation of the second support frame; 113 and 121 are front and rear gripping arms; 122 is a wrenching device; 131 is a threaded screw-in type burial container.
Figure 5:
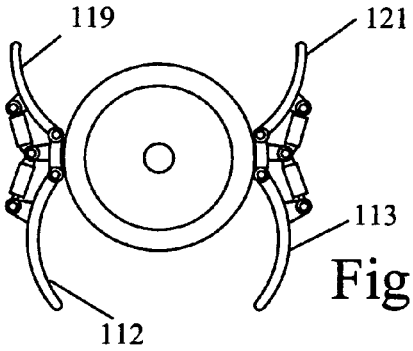
FIG. 5 is a view looking up from below of a burial container with the gripping arms of the present invention opened away from the burial container. 112 and 113 are front gripping arms; 119 and 121 are rear gripping arms.
Figure 6:
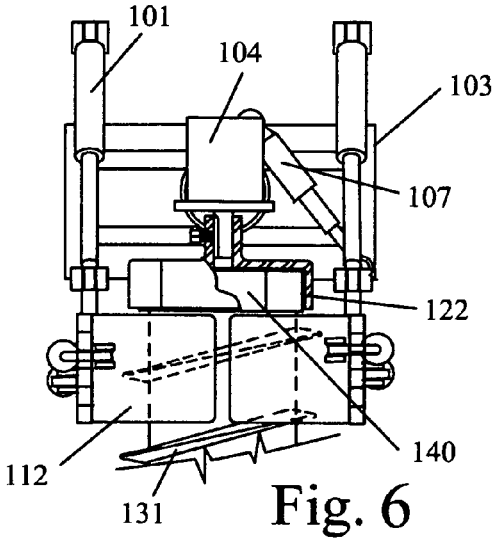
FIG. 6 is a front view of the present invention holding a screw in type burial container in a vertical position. Only the upper portion of the burial container is shown. 101 is an extendible and retractable linear actuator; 103 is the first support member; 104 is the motor; 107 is the extendible and retractable linear actuator controlling rotation of the second support frame; 112 is a front gripping arm; 122 is a wrenching device; 131 is a threaded screw-in burial container; 140 is the head piece of a burial container.
Figure 7:
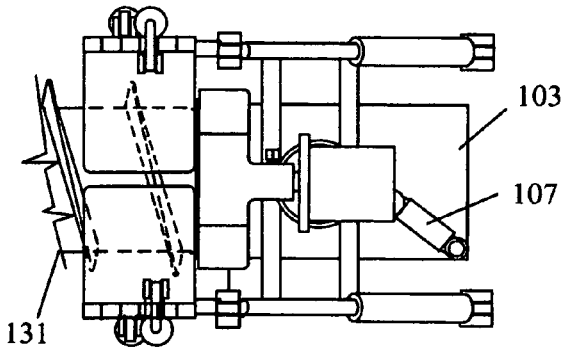
FIG. 7 is a front view of the present invention holding a threaded screw-in type burial container in a horizontal position. Only the upper portion of the burial container is shown. 103 is the mounting frame which mounts on a vehicle; 107 is the extendible and retractable linear actuator controlling rotation of the second support frame; 131 is a screw-in burial container.

The apparatus of the present invention is basically characterized by a first support frame, 103, FIG. 1, which attaches to a powered vehicle, 100, FIG. 1, and which has a horizontally extending member, 116, FIG. 4, over which a second member, 106, FIG. 1, is mounted with bearings between the two members. The second member rotates around the first member as a second support frame. An extendible and retractable linear actuator, 107, FIG. 1, is mounted on an arm, 102, FIG. 1, which is attached to the second support frame, and is attached at its opposite end to a fixture, 117, on the first support frame to control the relationship between the first and second support frames. This arrangement provides for the second support frame to be rotationally controlled between a horizontal and a vertical position. A bi-directional motor, 104, FIG. 1, is mounted on the second support frame. A wrenching device, 122, FIG. 1, matching the shape of the headpieces of screw-in and self digging burial containers, coffins or coffers, to be interred is mounted on the output shaft, 108, FIG. 1, of the motor.

Figure 2:
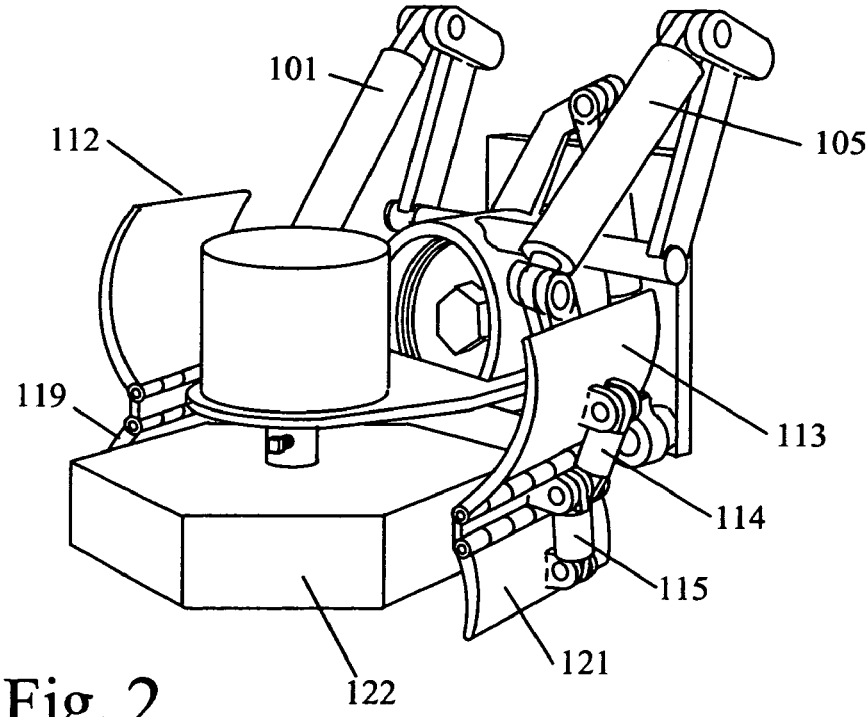
FIG. 2 is a perspective view of the present invention, with its gripping arms in an up position and open and with the apparatus ready to be fitted onto a vehicle. 101 and 105 are extendible and retractable linear actuators; 112 and 113 are front gripping arms; 114 and 115 are gripping arm extendible and retractable linear actuators; 119 and 121 are rear gripping arms; 122 is a socket wrenching device.
Figure 3:
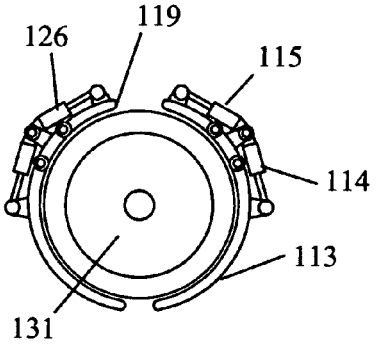
FIG. 3 is a view looking up from below of a burial container with the gripping arms of the present invention closed around a burial container, 131. 113 is a front gripping arm; 114, 115 and 126 are gripping arm extendible and retractable linear actuators; 131 is a burial container.

The second support frame has a fixed cross beam, 110, FIG. 1, extending out to each side on which are affixed brackets to hold the upper ends of extendible and retractable linear actuators, 101 and 105, FIG. 1, which are attached at their opposite ends to arms, 111, FIG. 1, on each side of the main body of the second support frame. The arms, 111, FIG. 1, pivot on a second fixed cross beam, 109, FIG. 1, and extend downward past the pivot point. The section of these arms below the pivot point contain hinge lines for front gripping arms, 112 and 113, FIG. 1, and rear gripping arms, 119 and 121, FIG. 2. Extendible and retractable linear actuators, 114 and 115, FIG. 1, attached to the pivot arms at one end, between the hinge lines, and to the gripping arms at their opposite ends, provide control for opening and closing the gripping arms The invented apparatus is attached to a vehicle, 100, FIG. 8, and hooked up to the power of the vehicle. The gripping arms, 113, FIG. 8, are opened and the apparatus is rotated to align with the burial container, 131, FIG. 8. The burial container, having a shaped headpiece, 140, FIG. 8, is picked up by the apparatus, with its shaped wrenching device, 122, FIG. 8, fitted over the headpiece of the burial container. The gripping arms, 113, are closed as shown in FIG. 9.

The vehicle moves the burial container to the grave site, as illustrated in FIG. 9. Once the burial container is at the spot where it is to be interred, 145, FIG. 10, it is rotated by way of an extendible and retractable linear actuator, 107, FIG. 1, to be perpendicular to the ground surface. The burial container is then pressed downward into the receiving material. This action securely sets the top of the burial container into the wrenching device, 122, FIG. 1, mounted on the motor. The gripping arms 112 and 113, FIG. 1, are then loosened slightly to reduce drag and the motor is rotated to cause the wrenching device to rotate the burial container in the proper direction. The burial container, by way of its screw threads or cutting edges, enters and continues into the ground or receiving material, FIG. 11. Downward pressure and rotation are maintained on the burial container until the bottom edges of the gripping arms, 112, FIG. 11, approach ground level, 142, FIG. 11. The gripping arms, 112, FIG. 12, are then opened and pivoted upward away from the ground, allowing the entire apparatus and burial container to continue downward until the wrenching device, 122, FIG. 12, has interred the burial container to a position at or below ground level, 142, FIG. 12.

I claim:

1. An apparatus for gripping, lifting, rotating and revolving burial containers designed to be interred into the ground when pressed onto the ground and rotated comprising:

a first support frame having a first horizontally extending member, a second support frame having an extending member fitted around said first horizontally extending member of said first support frame for rotation of said second support frame around said first horizontally extending member of said first support frame, a first extendible-retractable linear actuator having a first end attached to a fixture mounted on said first support frame and a second end attached to a fixture mounted on said second support frame for controlling the angular relationship between said first support frame and said second support frame, a motor mounted on said second support frame, said motor having an outwardly extending rotary output shaft, a wrenching device shaped to fit the head piece of said burial container on said outwardly extending rotary output shaft of said motor mounted on said second support frame, at least one pivoting frame mounted on said second support frame, at least one extendible-retractable linear actuator coupled between said second support frame and said pivoting frame for controlling the angular relationship between said second support frame and said pivoting frame, a gripping device mounted on said pivoting frame to close around and grip said burial container, at least one third extendible-retractable linear actuator attached between said pivoting frame and said gripping arm for controlling the relationship of said pivoting frame and said gripping arm to where said gripping arm can be raised above the bottom edge of said wrenching device to provide clearance for said wrenching device to operate at or below the surface of the ground during interment of a burial container.

* * * * *